US012612219B2

(12) United States Patent
Fan et al.

(10) Patent No.: US 12,612,219 B2
(45) Date of Patent: Apr. 28, 2026

(54) SEALING STRUCTURE

(71) Applicant: Lite-On Technology Corporation, Taipei (TW)

(72) Inventors: Yun Hao Fan, Taipei (TW); Chia Tsang Hsu, Taipei (TW); Wan-Chen Chen, Taipei (TW); Ying Hsien Chen, Taipei (TW); Shuo-Jen Shieh, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 53 days.

(21) Appl. No.: 18/769,415

(22) Filed: Jul. 11, 2024

(65) Prior Publication Data

US 2025/0019129 A1 Jan. 16, 2025

Related U.S. Application Data

(60) Provisional application No. 63/657,132, filed on Jun. 7, 2024.

(30) Foreign Application Priority Data

Jul. 13, 2023 (CN) ..... 202321844174.7

(51) Int. Cl.
*B65D 43/20* (2006.01)
*B65D 1/42* (2006.01)

(52) U.S. Cl.
CPC ..... *B65D 43/20* (2013.01); *B65D 1/42* (2013.01); *B65D 2543/00194* (2013.01); *B65D 2543/00351* (2013.01); *B65D 2543/00453* (2013.01); *B65D 2543/0099* (2013.01)

(58) Field of Classification Search
CPC ..... H05K 5/063; H05K 7/1076; B65D 43/20; B65D 1/42; B65D 2543/00194; B65D 2543/00351; B65D 2543/00453; B65D 2543/0099
See application file for complete search history.

(56) References Cited

U.S. PATENT DOCUMENTS 7,862,380 B1 * 1/2011 Wang ..... H01R 13/52 439/694
8,790,124 B2 * 7/2014 Lee ..... H01R 31/06 439/131
9,236,699 B2 * 1/2016 Lai ..... H01R 13/665
(Continued)

*Primary Examiner* — Kareen K Thomas
(74) *Attorney, Agent, or Firm* — JCIPRNET

(57) ABSTRACT

A sealing structure includes a box body and a cover body. The box body includes a plurality of side walls respectively including a plurality of outer and inner portions, an annular groove formed on the inner portions, and an annular protrusion portion. Each outer portion has a level difference with the corresponding inner portion. Any two adjacent ones of the side walls form a corner portion. An outer surface of each corner portion forms a sharp corner. The annular groove is arc-shaped at a position corresponding to each corner portion. Each corner portion includes a hollowed-out area. The cover body includes a main body in a polygonal shape with sharp corners, an annular protrusion portion protruding from the main body, and an annular groove. The annular protrusion portions extend into the annular grooves, so that the cover body is sealedly joined to the box body.

24 Claims, 9 Drawing Sheets

(56) References Cited

U.S. PATENT DOCUMENTS

2010/0144194 A1* 6/2010 Umei ..... H05K 5/063
29/592.1
2021/0127505 A1* 4/2021 Lu ..... H01R 13/506

* cited by examiner

SEALING STRUCTURE

CROSS-REFERENCE TO RELATED APPLICATION

This application claims the priority benefit of China application serial no. 202321844174.7, filed on Jul. 13, 2023, and U.S. provisional application Ser. No. 63/657,132, filed on Jun. 7, 2024. The entirety of each of the above-mentioned patent applications is hereby incorporated by reference herein and made a part of this specification.

BACKGROUND

Technical Field

The disclosure relates to a sealing structure, and particularly relates to a waterproof and dustproof sealing structure.

Description of Related Art

In order to achieve waterproof and dustproof properties, many products, for example, have O-rings disposed at the joints of the shell structure to reduce the possibility of water droplets and dust invading into the interior of the product. However, such a design also increases the manufacturing cost. Another design method is to join the shell structure through ultrasonic welding, which can achieve effective sealing without the need for configuring the O-rings in the shell structure. However, if ultrasonic welding is to be applied to the joining of the entire peripheral edge of the product shell, the shell usually needs to be designed to have an arc-shaped corner, so that the ultrasonic welding groove line is configured along the arc-shaped corner to achieve a good welding effect. As a result, it is impossible to meet the design requirements of some products that require sharp corners or right angles.

SUMMARY

The disclosure provides a sealing structure, which has sharp corners between side walls and has good waterproof and dustproof effects.

The disclosure discloses a sealing structure including a box body and a cover body. The box body includes a plurality of side walls and an annular groove. The side walls respectively include a plurality of outer portions and a plurality of inner portions. Each outer portion has a level difference with the corresponding inner portion. The annular groove is formed on the inner portions. A corner portion is formed between any two adjacent ones of the side walls. An outer surface of each corner portion is a sharp corner. The annular groove is arc-shaped at a position corresponding to each corner portion. Each corner portion includes a hollowed-out area. The cover body includes a main body and an annular protrusion portion protruding from the main body. The main body is in a shape of a polygon with sharp corners. The annular protrusion portion extends into the annular groove, so that the cover body is sealedly joined to the box body.

In an embodiment of the disclosure, the box body includes an annular protrusion portion extending from an inner peripheral edge of the annular groove, and the annular groove is formed between the main body of the cover body and the annular protrusion portion. The annular protrusion portion of the box body extends into the annular groove of the cover body, and the annular protrusion portion on the cover body extends into the annular groove of the box body, so that the cover body is sealedly joined to the box body.

In an embodiment of the disclosure, the hollowed-out area is formed in the inner portion and located between the annular groove and the outer portion.

In an embodiment of the disclosure, the box body further includes a bottom wall connected to the side walls. A projection of the hollowed-out area on a plane where the bottom wall is located does not overlap a projection of the annular groove of the box body on a plane where the bottom wall is located.

In an embodiment of the disclosure, the box body further includes the bottom wall connected to the side walls. The inner portions include a plurality of inner corner areas corresponding to the plurality of corner portions. The annular groove of the box body is recessed in an upper surface of the corresponding inner corner area at the position corresponding to each corner portion. The hollowed-out area of one of the corner portions extends from a bottom of the corresponding inner corner area to the bottom wall of the box body.

In an embodiment of the disclosure, the sealing structure also includes at least one reinforcing rib. The at least one reinforcing rib protrudes from the outer portion corresponding to the corner portion and is connected to the inner corner area and extends along a height direction of the box body. A thickness of the at least one reinforcing rib gradually decreases toward the bottom wall.

In an embodiment of the disclosure, the at least one reinforcing rib includes two reinforcing ribs, and the two reinforcing ribs are integrally formed with the side walls.

In an embodiment of the disclosure, the hollowed-out area of one of the corner portions corresponding to the side wall is formed on the outer surface of the side wall.

In an embodiment of the disclosure, the hollowed-out area includes a plurality of first hollowed-out sub-areas, which are arranged along the height direction of the box body and separated by a plurality of first spacers.

In an embodiment of the disclosure, the hollowed-out area of another corner portion corresponding to the side wall includes a plurality of second hollowed-out sub-areas separated by a plurality of second spacers. The side wall is disposed with a plurality of third hollowed-out sub-areas near the bottom wall. The third hollowed-out sub-areas are arranged along the bottom wall and separated by a plurality of third spacers. The first hollowed-out sub-areas, the second hollowed-out sub-areas, and the third hollowed-out sub-areas are configured in a U shape.

In an embodiment of the disclosure, inner surfaces of the outer portions at the positions corresponding to the corner portions are sharp corners or arc-shaped.

Based on the above, the box body of the sealing structure of the disclosure includes the plurality of side walls, the annular groove, and the annular protrusion portion, and the cover body includes the main body, the annular protrusion portion protruding from the main body, and the annular groove formed between the main body and the annular protrusion portion. The outer surface of the corner portion formed by the side walls is a sharp corner, and the main body of the cover body is a sharp corner. Therefore, after the cover body and the box body are combined, the appearance of the sealing structure can have sharp corners to meet the design requirements of a specific appearance. At the same time, the annular grooves of the box body and the cover body are arc-shaped at the corresponding corners, which is conducive to joining the box body and the cover body through ultrasonic welding, so that the sealing structure can achieve excellent waterproof and dustproof effects. On the other hand, each corner portion includes a hollowed-out area, which can effectively reduce the thickness of each corner portion, ensuring that the sealing structure will not shrink in appearance due to uneven thickness during the cooling process of the injection-molded finished product.

DESCRIPTION OF THE EMBODIMENTS

Figure 1:
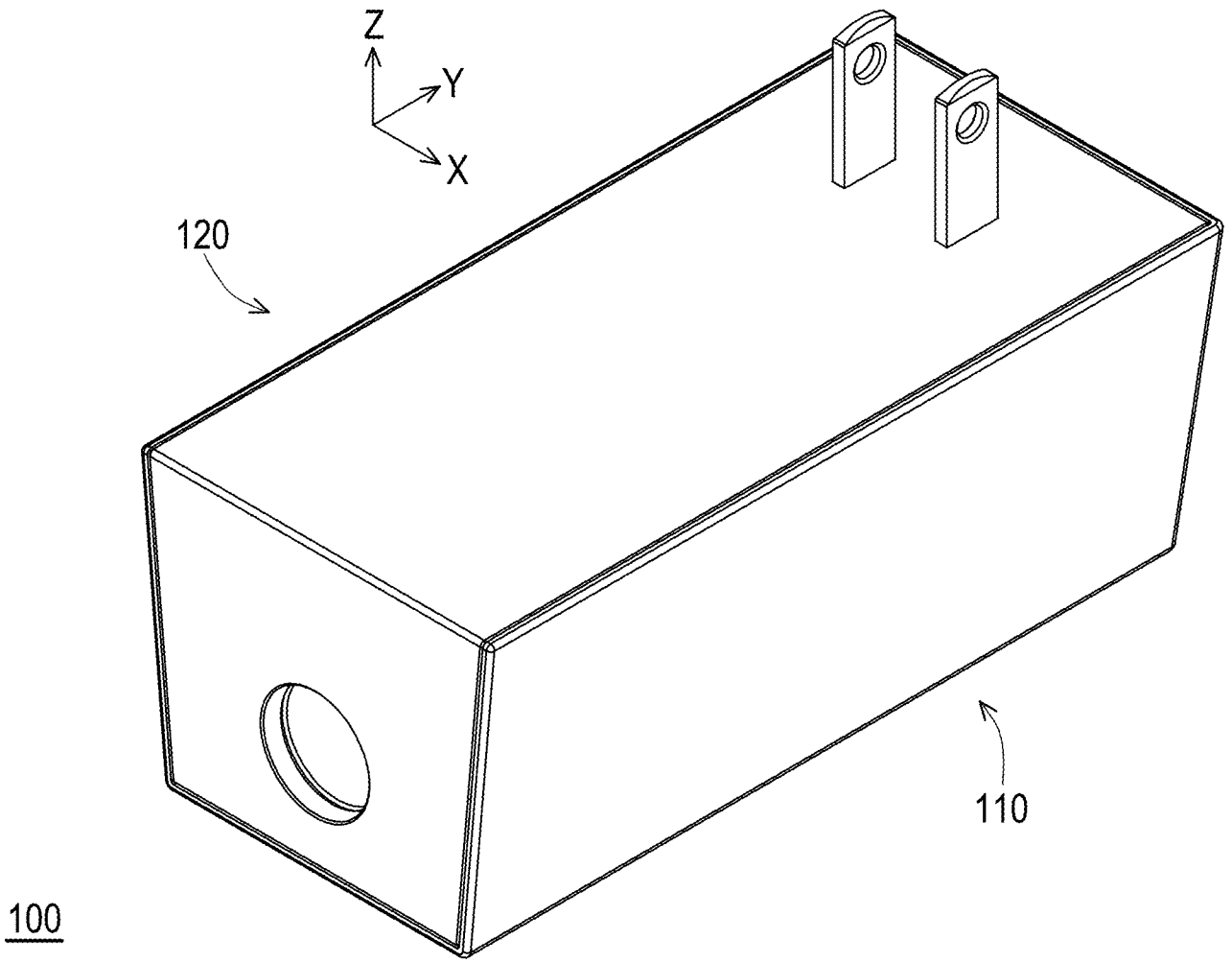
FIG. 1 is a schematic diagram of a sealing structure according to an embodiment of the disclosure.

Reference will now be made in detail to present preferred embodiments of the disclosure, examples of which are illustrated in the accompanying drawings. Whenever possible, the same reference numbers are used in the drawings and the description to refer to the same or like parts.

FIG. 1 is a schematic diagram of a sealing structure according to an embodiment of the disclosure. Referring to FIG. 1, in the embodiment, a sealing structure 100 includes a box body 110 and a cover body 120. The cover body 120 is sealedly joined to the box body 110, so that the sealing structure 100 can achieve waterproof and dustproof effects. The sealing structure 100 is applicable to, for example, electronic devices to prevent water droplets and dust from invading the electronic devices and causing damage to internal components, but the application of the sealing structure 100 is not limited thereto. In addition, the box body 110 can be manufactured by injection molding.

Figure 2A:
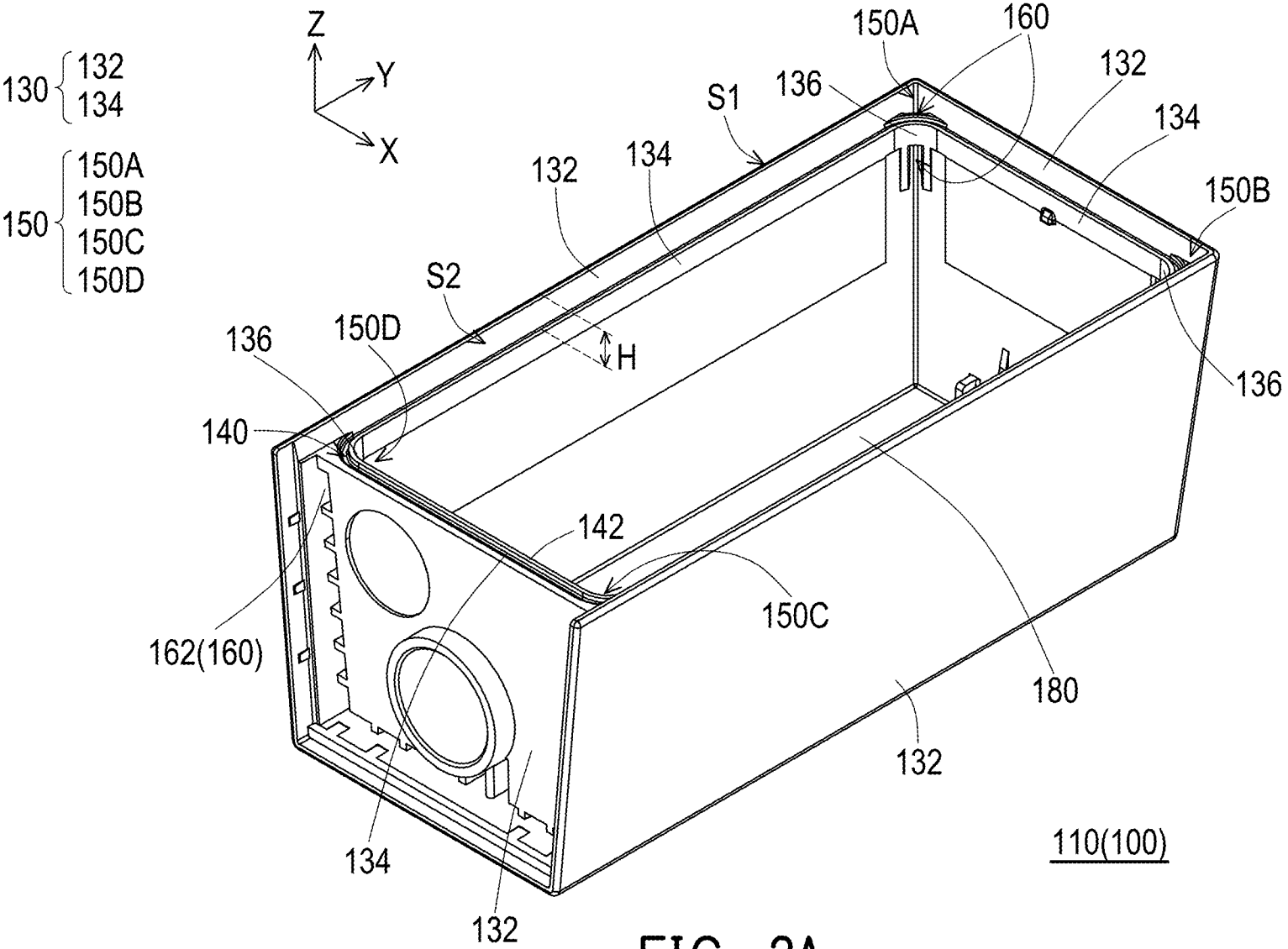
FIG. 2A is a schematic diagram of a box body of the sealing structure of FIG. 1.
Figure 2B:
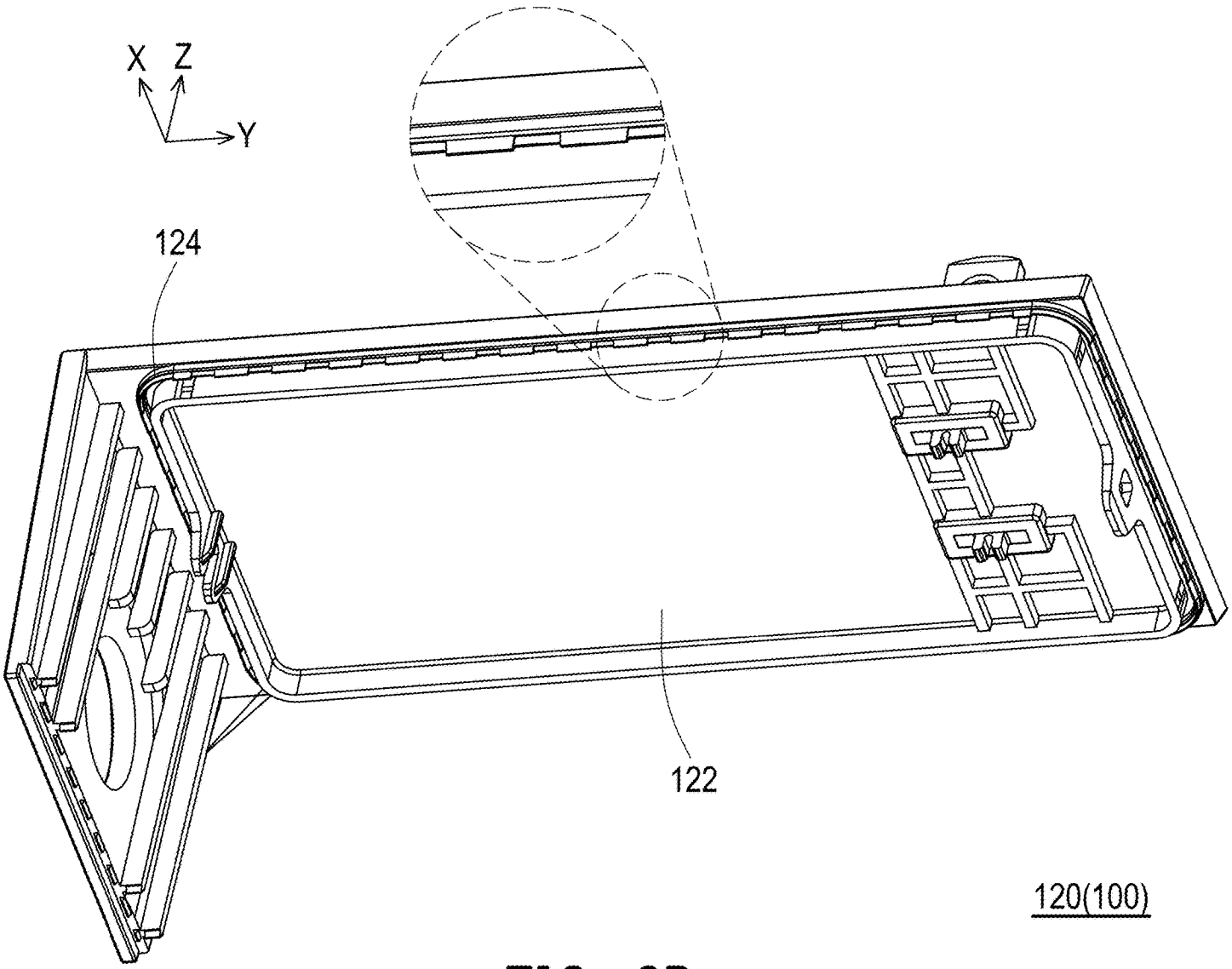
FIG. 2B is a schematic diagram of a cover body of the sealing structure of FIG. 1 from another viewing angle.

FIG. 2A is a schematic diagram of a box body of the sealing structure of FIG. 1. FIG. 2B is a schematic diagram of a cover body of the sealing structure of FIG. 1 from another viewing angle. Referring to FIG. 2A and FIG. 2B, the box body 110 of the embodiment includes a plurality of side walls 130 (four are shown), a bottom wall 180, and an annular groove 140. The side walls 130 are connected to the bottom wall 180 and respectively include a plurality of outer portions 132 and a plurality of inner portions 134.

Specifically, the outer portion 132 has an outer surface S1 and an inner surface S2 opposite to each other. The outer surface S1 is an appearance surface of the box body 110, and the inner surface S2 corresponds to a space surrounded by the side walls 130. The inner portion 134 is a portion of the side wall 130 that protrudes from the inner surface S2 of the outer portion 132. Each outer portion 132 has a level difference H with respect to the corresponding inner portion 134.

A corner portion 150 (four corner portions 150A, 150B, 150C, and 150D are shown) is formed between any two adjacent side walls 130. The outer surface S1 of each corner portion 150 forms a sharp angle (e.g., a right angle). The inner portion 134 includes a plurality of inner corner areas 136 corresponding to the corner portions 150. The annular groove 140 is formed on the inner portion 134 to serve as a welding groove line for ultrasonic welding. The inner corner area 136 has an arc angle, and the annular groove 140 is arc-shaped at the position corresponding to each corner portion 150.

Specifically, an outer peripheral edge of the annular groove 140 is formed on the inner portion 134, and an inner peripheral edge extends from the inner portion 134 to form an annular protrusion portion 142.

On the other hand, the cover body 120 (FIG. 2B) includes a main body 122 (FIG. 2B) and an annular protrusion portion 124 (FIG. 2B) protruding from the main body 122. The main body 122 is in a shape of a polygon with sharp corners (e.g., right angles). The annular protrusion portion 124 corresponds to the annular groove 140 of the box body 110.

Figure 2C:
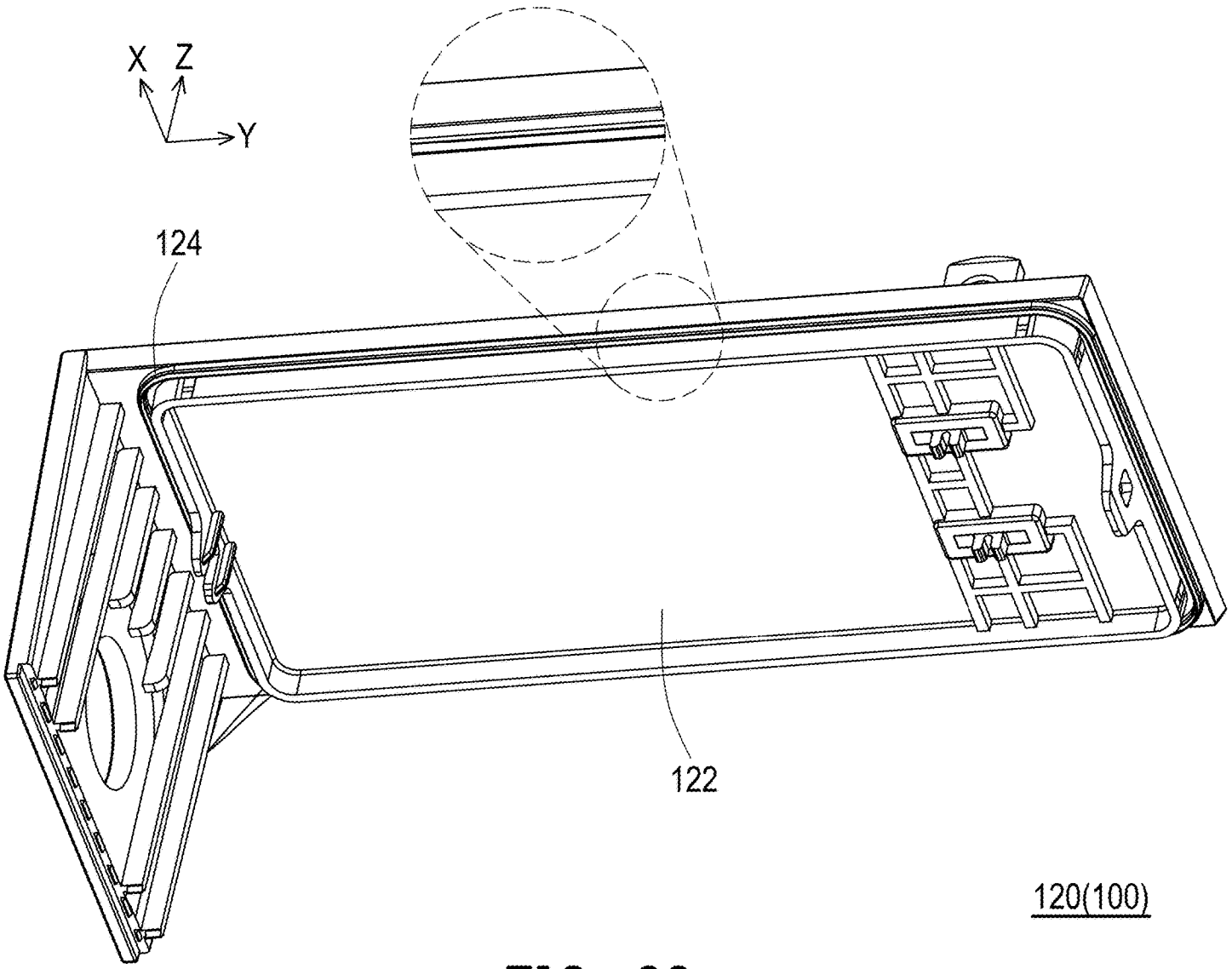
FIG. 2C is a schematic diagram of a cover body of the sealing structure according to another embodiment of the disclosure.

FIG. 2C is a schematic diagram of a cover body of the sealing structure according to another embodiment of the disclosure. Referring to FIG. 2C, the main difference between FIG. 2C and FIG. 2B is that the edge of the annular protrusion portion 124 in FIG. 2C is smooth.

Figure 6A:
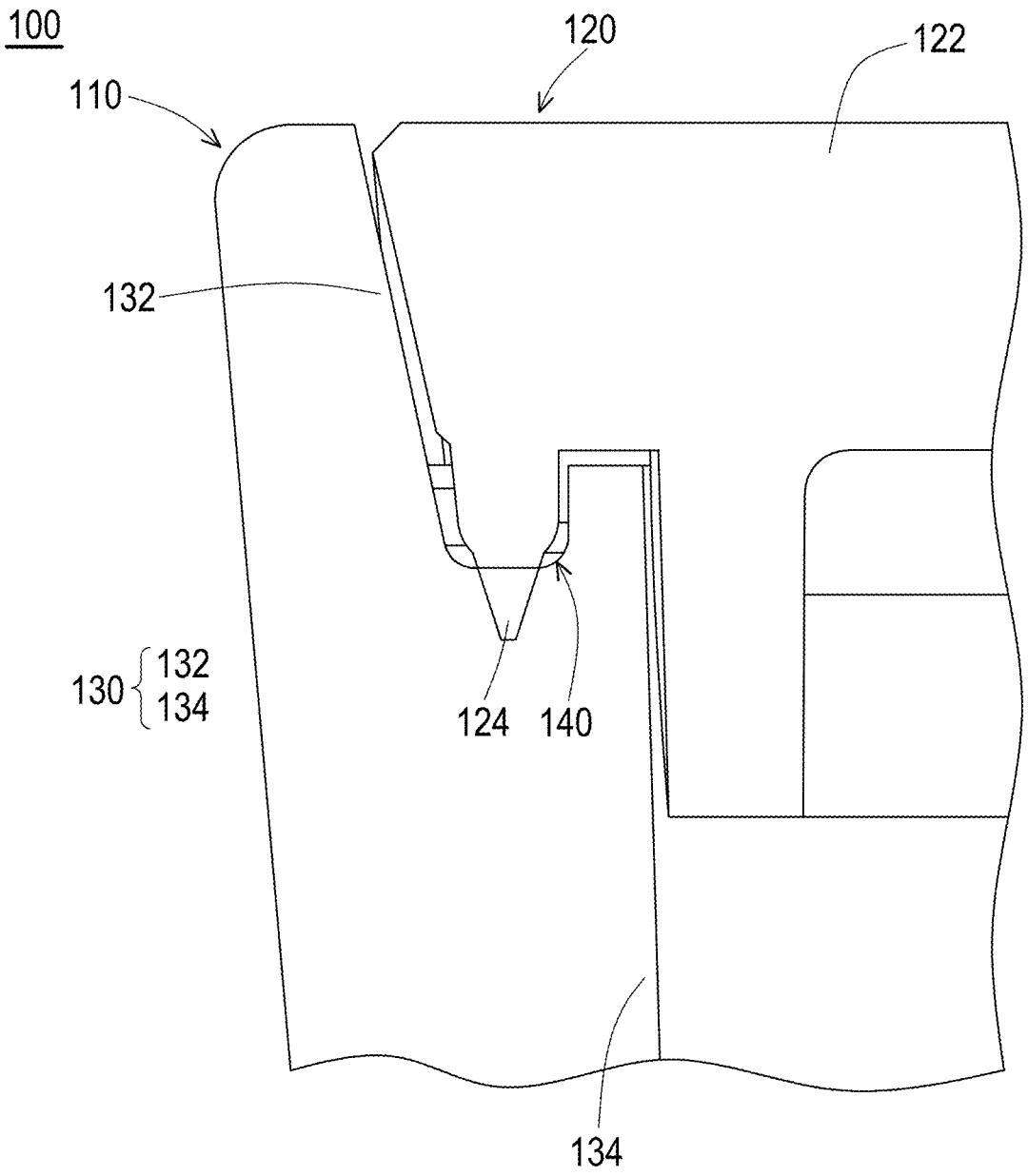
FIG. 6A and FIG. 6B are cross-sectional diagrams of a joint between the box body and the cover body of the sealing structure of FIG. 1.

FIG. 6A is a cross-sectional diagram of a joint between the box body 110 and the cover body 120 of the sealing structure 100. Referring to FIG. 6A, when the cover body 120 is combined with the box body 110, the annular protrusion portion 124 extends into the annular groove 140, and then the cover body 120 can be sealedly joined to the box body 110 by ultrasonic welding. According to actual measurements, the sealing structure 100 of the embodiment reaches the waterproof and dustproof grade IP 66, and has excellent waterproof and dustproof effects. In addition, since the box body 110 has the level difference H, the main body 122 of the cover body 120 can be completely and tightly fitted between the side walls 130, thereby improving the planarity of the appearance of the sealing structure 100.

On the other hand, in another embodiment, the box body 110 has the annular groove 140 and the annular protrusion portion 142, and the cover body 120 also has the annular protrusion portion 124 and an annular groove 126 correspondingly, so that the box body 110 and the cover body 120 are more firmly combined. Specifically, the outer peripheral edge of the annular groove 140 of the box body 110 is formed on the inner portion 134, and the inner peripheral edge extends from the inner portion 134 to form the annular protrusion portion 142. The cover body 120 includes the main body 122 and the annular protrusion portion 124 protruding from the main body 122, and the annular protrusion portion 124 is recessed between the main body 122 and the annular protrusion portion 124.

That is, the annular protrusion portion 124 of the cover body 120 corresponds to the annular groove 140 of the box body 110; and the annular protrusion portion 142 of the box body 110 corresponds to the annular groove 126 of the cover body 110.

Figure 6B:
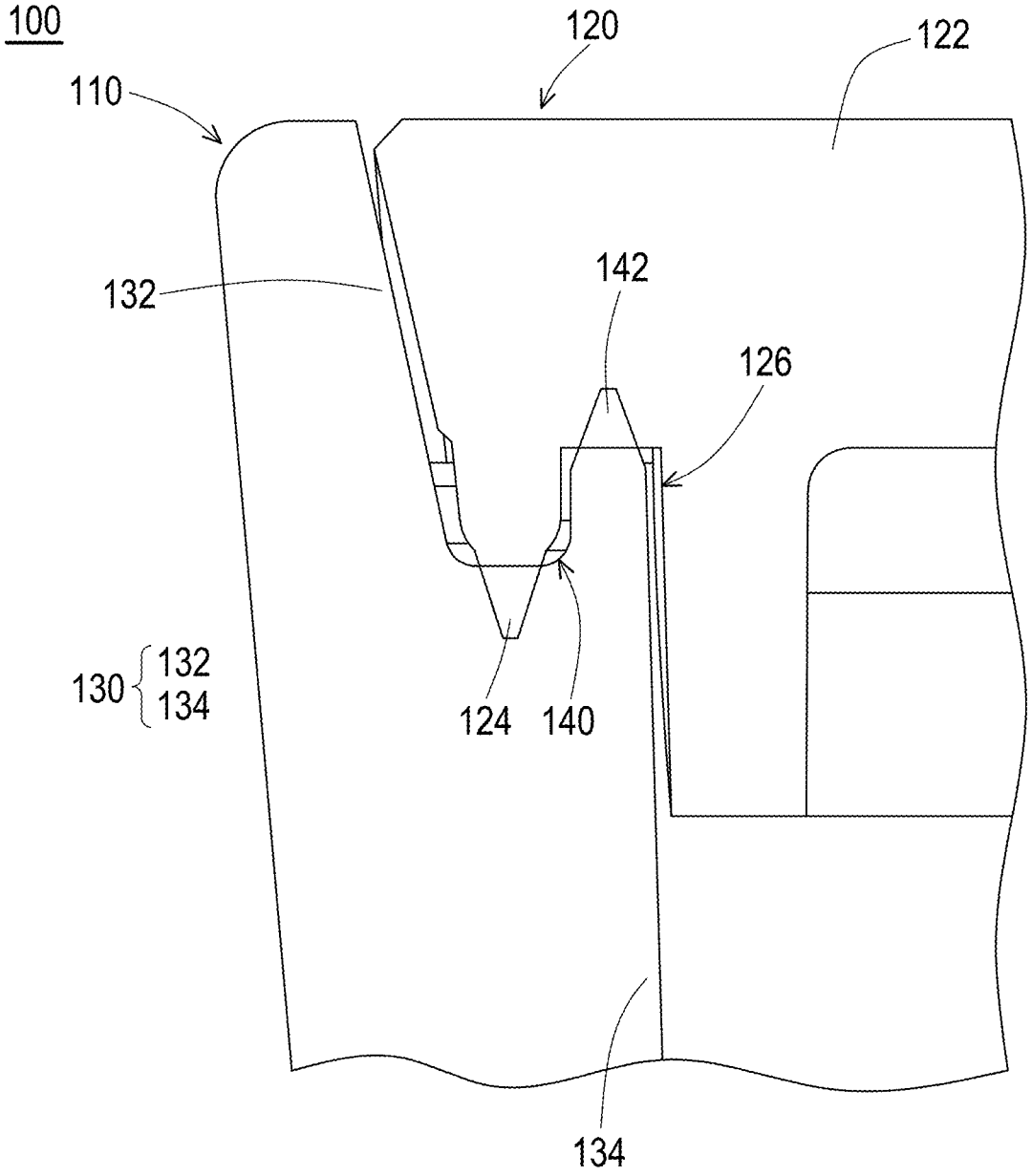

FIG. 6B is a cross-sectional diagram of a joint between the box body 110 and the cover body 120 of another embodiment of the sealing structure 100. Referring to FIG. 6B, when the cover body 120 is combined with the box body 110, the annular protrusion portion 124 of the cover body 120 extends into the annular groove 140 of the box body 110 and the annular protrusion portion 142 of the box body 110 extends into the annular groove 126 of the cover body 120.

The two groups of annular protrusion portion and annular groove are tightly combined with each other by ultrasonic welding.

The embodiment is welded in two steps. According to actual measurement, the sealing structure 100 of the embodiment reaches the waterproof and dustproof grade IP 67, and has excellent waterproof and dustproof effects. In addition, since the box body 110 has the level difference H, the main body 122 of the cover body 120 can be completely and tightly fitted between the side walls 130, thereby improving the planarity of the appearance of the sealing structure 100.

It is worth noting that it is generally difficult to use ultrasonic welding to seal the entire peripheral edge of the shell of the product having sharp corners. This is because the ultrasonic welding groove line is not suitable for being configured at sharp corners, so it is not easy to achieve a good welding effect. Although the above situation can be avoided by designing the corners of the shell to be arc-shaped, it cannot meet the design requirements of some products that require sharp corners.

In contrast, in the present embodiment, the outer surface S1 of the box body 110 of the sealing structure 100 has a sharp corner, the cover body 120 also has a sharp corner, and the annular groove 140 serving as the welding groove line is arc-shaped at each corner portion 150. Therefore, such a design can not only meet the appearance requirements of having sharp corners, but also can use ultrasonic welding to join the cover body 120 and the box body 110 along the entire peripheral edge. Therefore, the sealing structure 100 can achieve excellent waterproof and dustproof properties without the need for configuring additional sealing elements such as O-rings, while also saving manufacturing costs.

In the embodiment, the outer surface S1 of the corner portion 150 has a sharp corner and the inner corner area 136 has an arc angle. In general, such a design will make the thickness of the corner portion 150 greater than the thickness of other portions of the side wall 130. During the cooling process of the injection-molded product, if the thickness of the box body 110 is uneven, it is easy for parts with different thicknesses to have different cooling rates, resulting in inconsistent size reduction of these parts and thereby causing defects on the surface of the box body 110. Therefore, each corner portion 150 of the present embodiment is provided with a hollowed-out area 160 to make the overall thickness of the box body 110 uniform, thereby bringing good molding quality. The design of the hollowed-out area 160 will be further described below.

Figure 3:
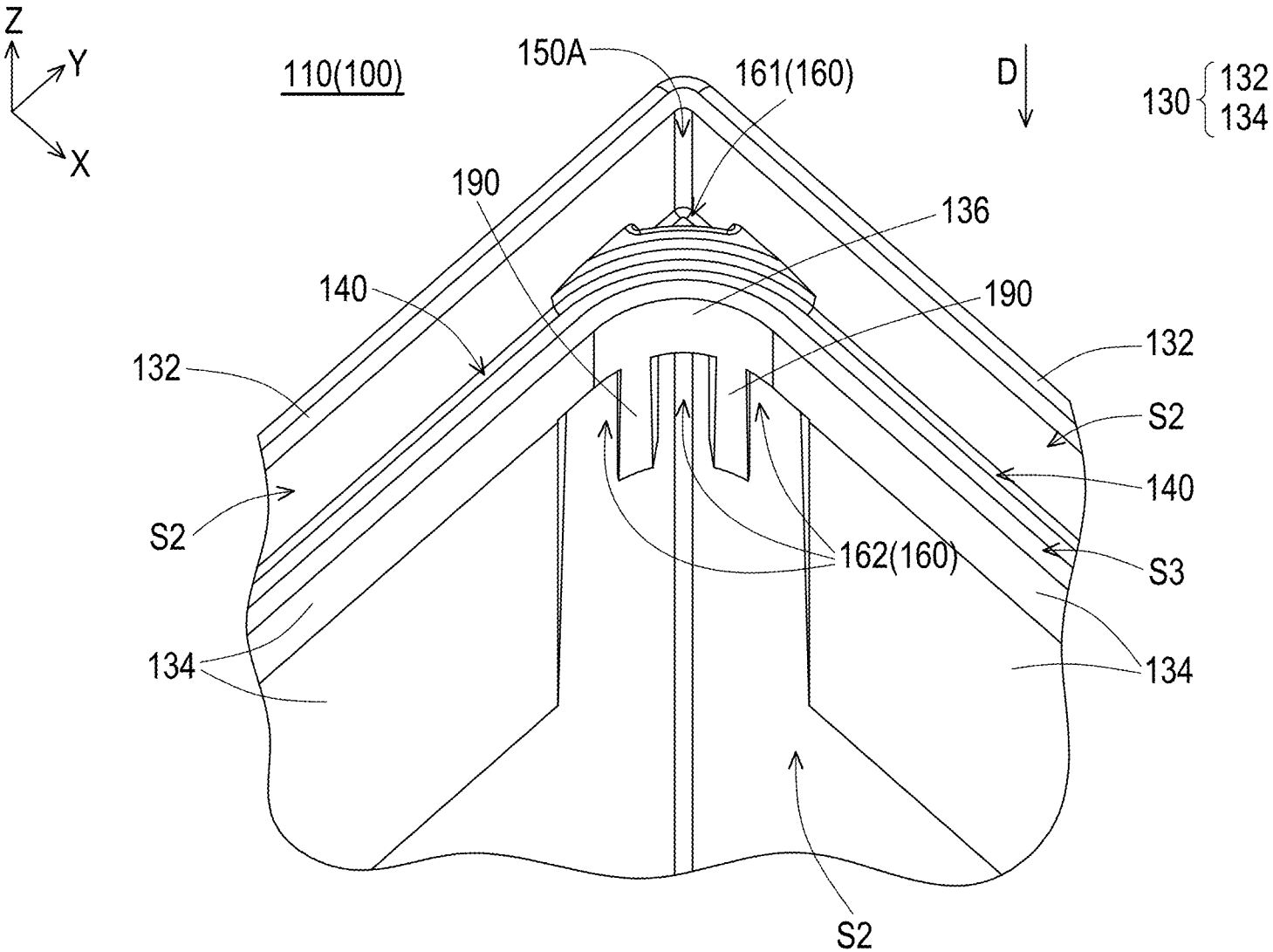
FIG. 3 is a partially enlarged schematic diagram of the box body of FIG. 2A from another viewing angle.

FIG. 3 is a partially enlarged schematic diagram of the box body of FIG. 2A from another viewing angle. Referring to FIG. 3, taking the corner portion 150A as an example, the hollowed-out area 160 of the corner portion 150A includes an upper hollowed-out area 161 and a lower hollowed-out area 162. The annular groove 140 is recessed into an upper surface S3 of the corresponding inner corner area 136 at the position corresponding to the corner portion 150A. The upper hollowed-out area 161 is formed at the inner corner area 136 of the inner portion 134. Specifically, the upper hollowed-out area 161 is recessed in the upper surface S3 of the inner corner area 136 and located between the annular groove 140 and the outer portion 132. That is, a projection of the upper hollowed-out area 161 on a plane where the bottom wall 180 (FIG. 2A) is located does not overlap a projection of the annular groove 140 on a plane where the bottom wall 180 is located.

On the other hand, the lower hollowed-out area 162 extends from below the corresponding inner corner area 136 to the bottom wall 180 of the box body 110 to further reduce the thickness of the corner portion 150A. In addition, the sealing structure 100 of the embodiment further includes at least one reinforcing rib 190, and the number of the reinforcing ribs 190 is, for example, two.

The inner portion of the side wall 130 is hollowed out at the corner portion 150A, so the inner portion 134 protrudes from the outer portion 132, and the reinforcing rib 190 is a supporting structure left after the inner portion is hollowed out at the corner portion 150A. The reinforcing rib 190 protrudes from the outer portion 132 corresponding to the corner portion 150A, is connected to the inner corner area 136, and extends along a height direction (i.e., a Z-axis direction) of the box body 110. The reinforcing rib 190 is integrally formed with the side wall 130, and the thickness of the reinforcing rib 190 gradually decreases toward the bottom wall 180. Since the reinforcing rib 190 is disposed below the inner corner area 136, it can support the suspended inner corner area 136, thereby improving the structural strength of the corner portion 150A.

In the embodiment, the upper hollowed-out area 161 and the lower hollowed-out area 162 are not only disposed at the corner portion 150A, but may also be disposed at the corner portion 150B on the right side of FIG. 2A. The design of the upper hollowed-out area 161 and the lower hollowed-out area 162 can effectively reduce the thickness of the corner portion 150, thereby preventing surface defects of the box body 110 due to uneven thickness during the cooling process of the injection-molded finished product, thereby achieving good molding quality.

In addition, if the box body 110 of the present embodiment is manufactured by injection molding, the upper hollowed-out area 161 and the lower hollowed-out area 162 can be formed by means of a lifter design of the mold. The lifter is a known technology for mold design, and its design method will not be described in detail here.

Figure 4:
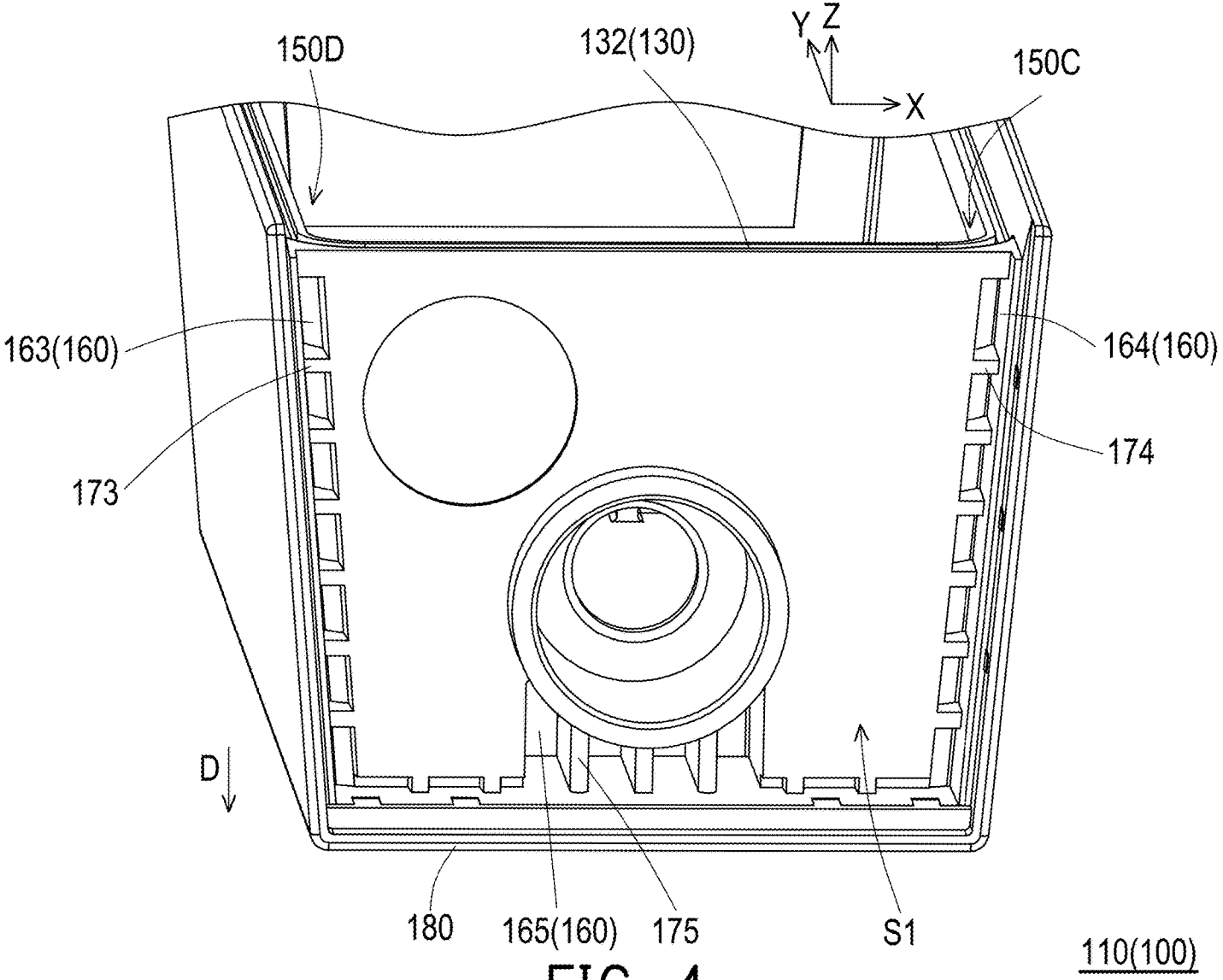
FIG. 4 is a partially enlarged schematic diagram of the box body of FIG. 2A from another viewing angle.

FIG. 4 is a partially enlarged schematic diagram of the box body of FIG. 2A from another viewing angle. Referring to FIG. 4, unlike the hollowed-out area 160 of the corner portion 150A of FIG. 3 disposed on the inner surface S2 of the side wall 130, the hollowed-out area 160 of one of the corner portions 150D corresponding to the side wall 130 of FIG. 4 is formed on the outer surface S1 of another side wall 130.

In detail, the hollowed-out area 160 includes a plurality of first hollowed-out sub-areas 163. The first hollowed-out sub-areas 163 are recessed in the outer surface S1 of the outer portion 132, arranged along the height direction (i.e., the Z-axis direction) of the box body 110, and separated by a plurality of first spacers 173.

Similarly, another corner portion 150C corresponding to the same side wall 130 is also provided with the hollowed-out area 160, and the hollowed-out area 160 includes a plurality of second hollowed-out sub-areas 164. The second hollowed-out sub-areas 164 are recessed in the outer surface S1 of the outer portion, arranged along the height direction of the box body 110, and separated by a plurality of second spacers 174.

In addition, the same side wall 130 is further provided with a plurality of third hollowed-out sub-areas 165 near the bottom wall 180. The third hollowed-out sub-areas 165 are recessed in the outer surface S1 of the outer portion, arranged along the bottom wall 180, and separated by a plurality of third spacers 175. The first hollowed-out sub-areas 163, the second hollowed-out sub-areas 164, and the third hollowed-out sub-areas 165 are configured in a U shape. By means of the first hollowed-out sub-areas 163 and the second hollowed-out sub-areas 164, the local thickness of the corner portions 150C and 150D can be effectively reduced, thereby preventing surface defects of the box body 110 due to uneven thickness during the cooling process of the injection-molded finished product, thereby achieving good molding quality. In addition, the third hollowed-out sub-areas 165 can also effectively reduce the thickness of the side wall 130 near the bottom wall 180.

In addition, if the box body 110 of the present embodiment is manufactured by injection molding, the first hollowed-out sub-areas 163, the second hollowed-out sub-areas 164, and the third hollowed-out sub-areas 165 can be formed by means of a slider design of the mold. The slider is a known technology for mold design, and its design method will not be described in detail here.

Figure 5:
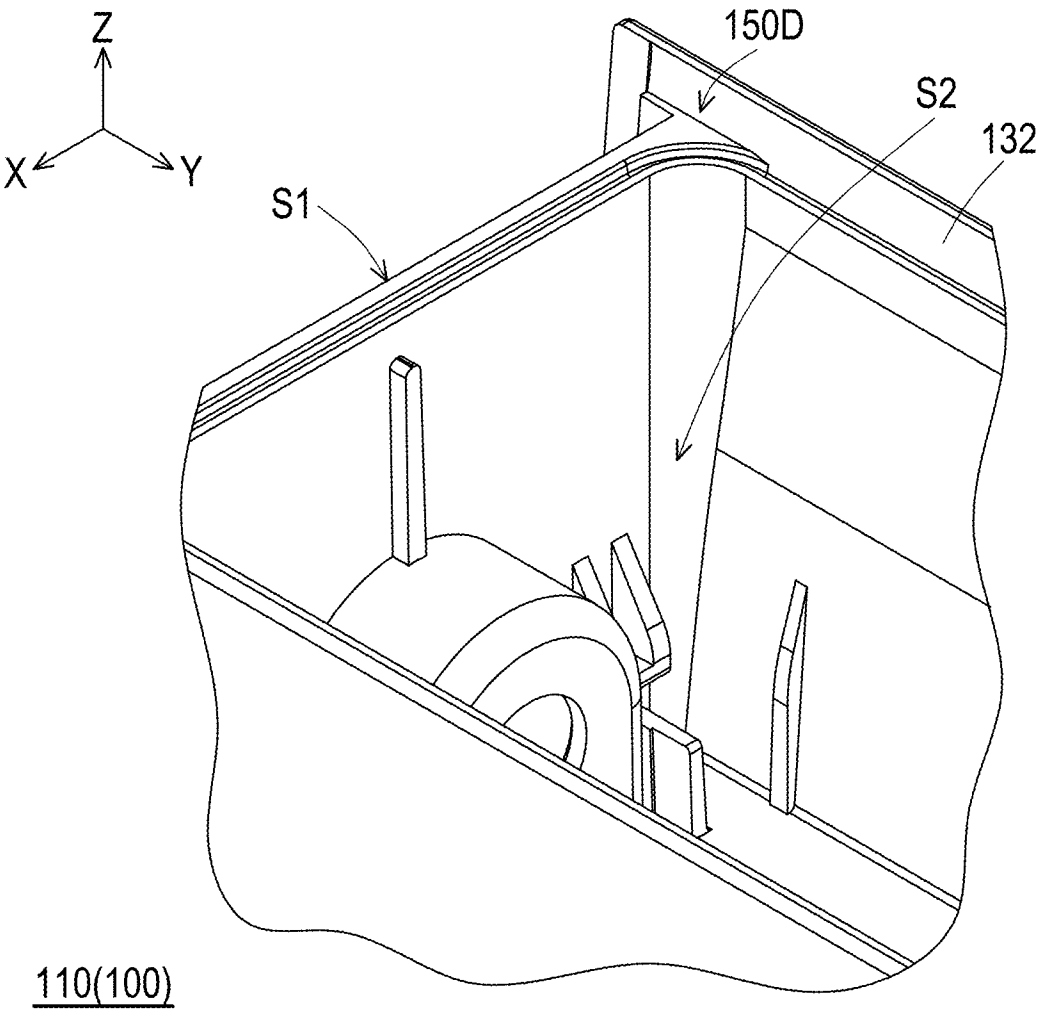
FIG. 5 is a partially enlarged schematic diagram of the box body of FIG. 2A from another viewing angle.

FIG. 5 is a partially enlarged schematic diagram of the box body of FIG. 2A from another viewing angle. Referring to FIG. 2A and FIG. 5, in the embodiment, the inner surfaces S2 of the outer portions 132 corresponding to the corner portions 150A, 150B, 150C, and 150D may be sharp corners or arc-shaped, depending on actual design requirements. Taking FIG. 2A as an example, the inner surface S2 of the outer portion 132 at the corner portion 150A is a sharp corner, which can reduce the thickness of the corner portion 150A. As shown in FIG. 5, the inner surface S2 of the outer portion 132 at the corner portion 150D is arc-shaped, making the inner surface S2 at this position smoother. Since the outer surface S1 of the corner portion 150D is provided with the plurality of first hollowed-out sub-areas 163 (FIG. 4), the thickness of the corner portion 150D can still be effectively reduced, thereby preventing surface defects of the box body 110 due to uneven thickness during the cooling process of the injection-molded finished product.

In summary, the box body of the sealing structure of the disclosure includes the plurality of side walls, the annular groove, and the annular protrusion portion, and the cover body includes the main body, the annular protrusion portion protruding from the main body, and the annular groove. The outer surface of the corner portion formed by the side walls is a sharp corner, and the main body of the cover body is a sharp corner. Therefore, after the cover body and the box body are combined, the appearance of the sealing structure can have sharp corners to meet the design requirements of a specific appearance. At the same time, the annular groove is arc-shaped at the positions corresponding to the corners, which is conducive to joining the box body and the cover body by ultrasonic welding, so that the sealing structure can achieve excellent waterproof and dustproof effects.

In another aspect, each corner portion includes the hollowed-out area. The hollowed-out area may be formed above and below the inner portion of the corner portion to effectively reduce the thickness of each corner portion, thereby ensuring that the sealing structure does not shrink in appearance due to uneven thickness during the cooling process of the injection-molded finished product. In addition, the hollowed-out area may be formed at the outer portion of the corner portion to further reduce the thickness of the corner portion, thereby making the overall thickness of the sealing structure more uniform.

Finally, it should be noted that the foregoing embodiments are only used to illustrate the technical solution of the disclosure, but not to limit the disclosure; although the disclosure has been described in detail with reference to the foregoing embodiments, persons of ordinary skill in the art should understand that the technical solutions described in the foregoing embodiments can still be modified, or parts or all of the technical features thereof can be equivalently replaced; however, these modifications or substitutions do not deviate the essence of the corresponding technical solutions from the scope of the technical solutions of the embodiments of the disclosure.

What is claimed is:

1. A sealing structure, comprising:

a box body, comprising a plurality of side walls and an annular groove, wherein the plurality of side walls respectively comprise a plurality of outer portions and a plurality of inner portions, each of the outer portions has a level difference with the corresponding inner portion; corner portions are formed between the plurality of side walls, each of the corner portions is formed between any two adjacent ones of the plurality of side walls, and an outer surface of each of the corner portions is formed as a sharp corner, the annular groove is formed on the plurality of inner portions and is arc-shaped at a position corresponding to each of the corner portions, and each of the corner portions comprises a hollowed-out area; and a cover body, comprising a main body and an annular protrusion portion protruding from the main body, wherein the main body is in a shape of a polygon with sharp corners, and the annular protrusion portion extends into the annular groove, so that the cover body is sealedly joined to the box body, wherein each of the annular groove and the annular protrusion portion forms a continuous ring and spans the corner portions.

2. The sealing structure according to claim 1, wherein the hollowed-out area is formed in the inner portion and located between the annular groove and the outer portion.

3. The sealing structure according to claim 2, wherein the box body further comprises a bottom wall connected to the plurality of side walls, and a projection of the hollowed-out area on a plane where the bottom wall is located does not overlap a projection of the annular groove on a plane where the bottom wall is located.

4. The sealing structure according to claim 1, wherein the box body further comprises a bottom wall connected to the plurality of side walls, the plurality of inner portions comprise a plurality of inner corner areas respectively corresponding to the plurality of corner portions, the annular groove is recessed in an upper surface of the corresponding inner corner area at the position corresponding to each of the corner portions, and the hollowed-out area of one of the corner portions extends from downside of the corresponding inner corner area to the bottom wall of the box body.

5. The sealing structure according to claim 4, further comprising at least one reinforcing rib, wherein the at least one reinforcing rib is connected to the inner corner area, protrudes from the outer portion corresponding to one of the corner portions, and extends along a height direction of the box body, and a thickness of the at least one reinforcing rib gradually decreases toward the bottom wall.

6. The sealing structure according to claim 5, wherein the at least one reinforcing rib comprises two reinforcing ribs, and the two reinforcing ribs are integrally formed with the plurality of side walls.

7. The sealing structure according to claim 1, wherein the hollowed-out area of one of the corner portions corresponding to the side wall is formed on an outer surface of the side wall.

8. The sealing structure according to claim 7, wherein the hollowed-out area comprises a plurality of first hollowed-out sub-areas, and the plurality of hollowed-out sub-areas are arranged along a height direction of the box body and separated by a plurality of first spacers.

9. The sealing structure according to claim 8, wherein the hollowed-out area of another corner portion of the corner portions corresponding to the side wall comprises a plurality of second hollowed-out sub-areas separated by a plurality of second spacers, the side wall is provided with a plurality of third hollowed-out sub-areas near a bottom wall, the plurality of third hollowed-out sub-areas are arranged along the bottom wall and separated by a plurality of third spacers, and the plurality of first hollowed-out sub-areas, the plurality of second hollowed-out sub-areas, and the plurality of third hollowed-out sub-areas are configured in a U shape.

10. The sealing structure according to claim 1, wherein inner surfaces of the plurality of outer portions at the positions corresponding to the corner portions are sharp corners or arc-shaped.

11. A sealing structure, comprising:

a box body, comprising a plurality of side walls, a first annular groove, and a first annular protrusion portion, wherein the plurality of side walls respectively comprise a plurality of outer portions and a plurality of inner portions, each of the outer portions has a level difference with the corresponding inner portion, the first annular groove is formed on the plurality of inner portions, the first annular protrusion portion is formed on an inner peripheral edge of the first annular groove, corner portions are formed between the plurality of side walls, each of the corner portions is formed between any two adjacent ones of the plurality of side walls, each of the corner portions is formed as a sharp corner, the first annular groove is arc-shaped at a position corresponding to each of the corner portions, and each of the corner portions comprises a hollowed-out area; and a cover body, comprising a main body, a second annular protrusion portion protruding from the main body, and a second annular groove, wherein the main body is in a shape of a polygon with sharp corners, the first annular protrusion portion extends into the second annular groove, the second annular protrusion portion extends into the first annular groove, and the cover body is sealedly joined to the box body, wherein each of the first annular groove and the second annular protrusion portion forms a continuous ring and spans the corner portions.

12. The sealing structure according to claim 11, wherein the hollowed-out area is formed in the inner portion and located between the first annular groove and the outer portion.

13. The sealing structure according to claim 12, wherein the box body further comprises a bottom wall connected to the plurality of side walls, and a projection of the hollowed-out area on a plane where the bottom wall is located does not overlap a projection of the first annular groove on a plane where the bottom wall is located.

14. The sealing structure according to claim 11, wherein the box body further comprises a bottom wall connected to the plurality of side walls, the plurality of inner portions comprise a plurality of inner corner areas respectively corresponding to the plurality of corner portions, the first annular groove is recessed in an upper surface of the corresponding inner corner area at the position corresponding to each of the corner portions, and the hollowed-out area of one of the corner portions extends from downside of the corresponding inner corner area to the bottom wall of the box body.

15. The sealing structure according to claim 14, further comprising at least one reinforcing rib connected to the inner corner area, protruding from the outer portion corresponding to one of the corner portions, and extends along a height direction of the box body, and a thickness of the at least one reinforcing rib gradually decreases toward the bottom wall.

16. The sealing structure according to claim 15, wherein the at least one reinforcing rib comprises two reinforcing ribs, and the two reinforcing ribs are integrally formed with the plurality of side walls.

17. The sealing structure according to claim 11, wherein the hollowed-out area of one of the corner portions corresponding to the side wall is formed on an outer surface of the side wall.

18. The sealing structure according to claim 17, wherein the hollowed-out area comprises a plurality of first hollowed-out sub-areas, and the plurality of hollowed-out sub-areas are arranged along a height direction of the box body and separated by a plurality of first spacers.

19. The sealing structure according to claim 18, wherein the hollowed-out area of another corner portion corresponding to the side wall comprises a plurality of second hollowed-out sub-areas separated by a plurality of second spacers, the side wall is provided with a plurality of third hollowed-out sub-areas near a bottom wall, the plurality of third hollowed-out sub-areas are arranged along the bottom wall and separated by a plurality of third spacers, and the plurality of first hollowed-out sub-areas, the plurality of second hollowed-out sub-areas, and the plurality of third hollowed-out sub-areas are configured in a U shape.

20. The sealing structure according to claim 11, wherein inner surfaces of the plurality of outer portions at the positions corresponding to the corner portions are sharp corners or arc-shaped.

21. A sealing structure, comprising:

a box body, comprising a plurality of side walls and an annular peripheral edge, wherein the plurality of side walls respectively comprise a plurality of outer portions and a plurality of inner portions, each of the outer portions has a level difference with the corresponding inner portion, the annular peripheral edge is formed on the plurality of inner portions, corner portions are formed between the plurality of side walls, each of the corner portions is formed between any two adjacent ones of the plurality of side walls, each of the corner portions is formed as a sharp corner, the annular peripheral edge is arc-shaped at a position corresponding to each of the corner portions, and each of the corner portions comprises a hollowed-out area; and a cover body, comprising a main body and an annular protrusion portion protruding from the main body, wherein the main body is in a shape of a polygon with sharp corners, and the annular protrusion portion fits the annular peripheral edge, so that the cover body is sealedly joined to the box body, wherein each of the annular peripheral edge and the annular protrusion portion forms a continuous ring and spans the corner portions.

22. The sealing structure according to claim 21, wherein the hollowed-out area is formed in the inner portion and located between the annular peripheral edge and the outer portion.

23. The sealing structure according to claim 21, wherein the box body further comprises a bottom wall connected to the plurality of side walls, and the plurality of inner portions comprise a plurality of inner corner areas corresponding to the corner portions, the sealing structure further comprising at least one reinforcing rib, wherein the at least one reinforcing rib protrudes from the outer portion corresponding to one of the corner portions, is connected to the inner corner area, and extends along a height direction of the box body, and a thickness of the at least one reinforcing rib gradually decreases toward the bottom wall.

24. The sealing structure according to claim 21, wherein inner surfaces of the plurality of outer portions at the positions corresponding to the corner portions are sharp corners or arc-shaped.

* * * * *